United States Patent [19]

Ehle

[11] Patent Number: 4,674,102

[45] Date of Patent: Jun. 16, 1987

[54] ELECTRIC ARC FURNACE

[75] Inventor: Joachim Ehle, Lautenbach, Fed. Rep. of Germany

[73] Assignee: Fuchs Systemtechnik GmbH, Willstätt-Legelshurst, Fed. Rep. of Germany

[21] Appl. No.: 874,134

[22] Filed: Jun. 13, 1986

[30] Foreign Application Priority Data

Jun. 24, 1985 [DE] Fed. Rep. of Germany ..... 3522559

[51] Int. Cl.[4] ..... H05B 7/10

[52] U.S. Cl. ..... 373/98; 373/94; 373/81

[58] Field of Search ..... 373/73, 81, 98, 99, 373/94

[56] References Cited

U.S. PATENT DOCUMENTS

| | | | |
|---|---|---|---|
| 2,290,028 | 7/1942 | Brooke | 373/98 |
| 2,290,029 | 7/1942 | Brooke | 373/98 |
| 3,404,209 | 10/1968 | Brooke | 373/81 |

*Primary Examiner*—Roy N. Envall, Jr.

[57] ABSTRACT

For the purposes of charging an electric arc furnace the cover (3) of the furnace is lifted somewhat and, being held by a cover carrier mechanism (10, 11), pivoted to the side. The cover carrier mechanism (10, 11) is connected to a portal structure (13) which is rotatable about a vertical axis. At the same time horizontal electrode support arms (5, 6, 7), with the electrodes secured to the free ends thereof, are pivoted to the side. The electrode support arms are secured to vertically displaceable lift columns (19, 20, 21). The lift columns are arranged in one plane and have roller guides (15*a,* 15*b;* 16*a,* 16*b*) which are disposed in two horizontal planes. The rollers of each pair (15*a,* 15*b* . . . ) are so inclined that their axes of rotation include an angle of between 90° and 160°. In that way moments about vertical axes upon pivotal movement of the arrangement and in operation of the furnace can be carried. By virtue of the compact arrangement of the roller guides and lift columns the portal structure may be in the form of a roller-type turntable which may be a commercially available component.

6 Claims, 3 Drawing Figures

ELECTRIC ARC FURNACE

DESCRIPTION

Figure 1:
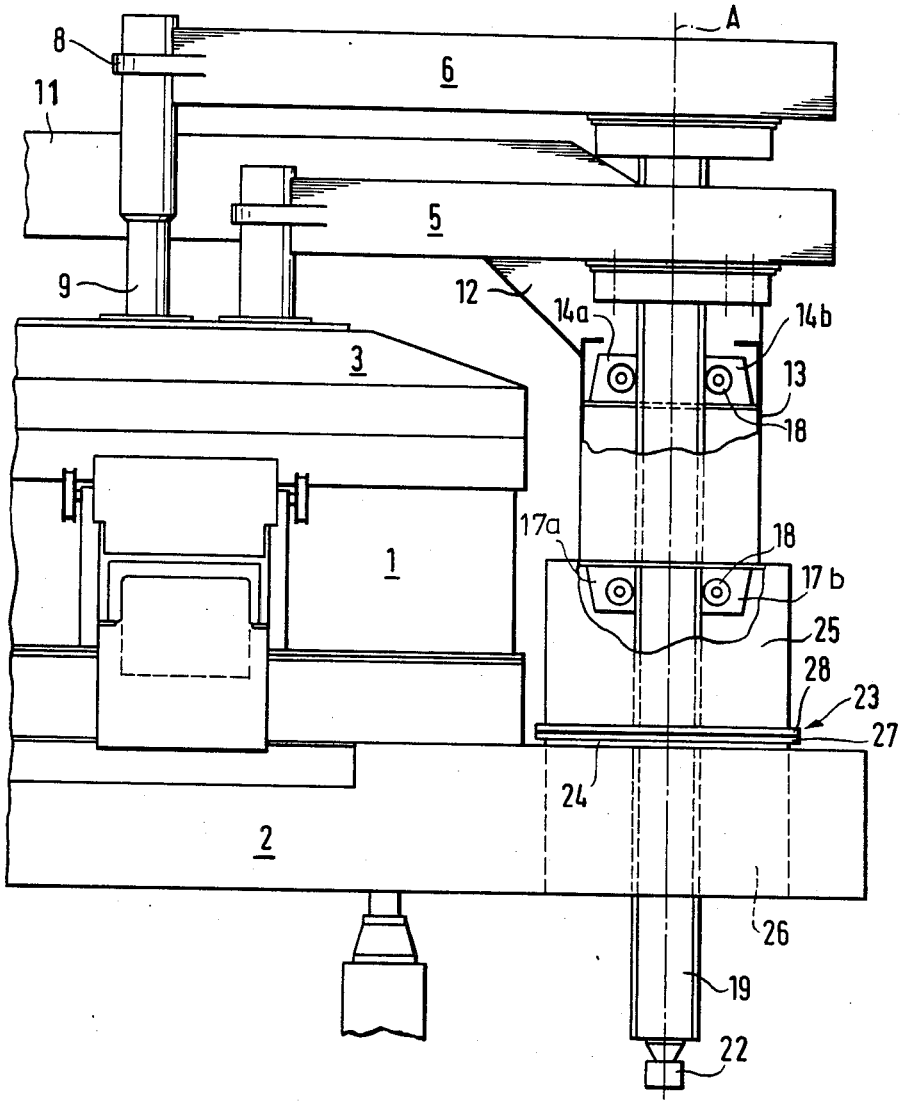

The invention relates to an electric arc furnace.

An electric arc furnace is disclosed in the journal ELEKTROWARME international, April 1983, No 2, edition B, title page. In that furnace, three lift columns of circular cross-section, which carry the electrode support arms, are arranged in side-by-side relationship, with each thereof being provided both on the side which is towards the cover or roof of the furnace and also on the side which is remote from the cover or roof of the furnace, with a bar member of square or rectangular cross-section, the surfaces of which serve as track or raceway surfaces for the roller guides. Associated with each bar member, at two different heights, are three roller guides of which the rollers each form an angle of 90° relative to each other. Accordingly two rollers in each case are disposed in a plane which extends in parallel relationship to the arrangement of the lift columns in a row, and by virtue of the amount of space that they occupy, they determine the spacing between the adjacent lift columns.

The roller guides for the lift columns are fixed, together with the furnace cover carrier mechanism, on a gantry or portal structure which can be pivoted about a vertical journal and which is mounted by means of support wheels on the platform of the furnace rocking cradle.

The prior patent application to the present applicant bearing the Ser. No 802,252 proposed that the conventional heavy-current tubes which are fitted on to the electrode support arms should be at least partially replaced by a copper layer or a layer of another material which is a good conductor, being applied to the outside of the electrode support arms. In such a construction, the spacing between the individual support arms can be reduced. It is thus desirable also to reduce the usual spacing between the lift columns on which the support arms are fixed.

The object of the present invention is to provide an electric arc furnace of the which makes it possible for the spacing between the lift columns and thus also the amount of space they occupy to be reduced. The invention further seeks thereby also to make it possible to use a commercially available construction for the rotary mounting arrangement, which eliminates the need for a special production.

That object is achieved by the features recited in claim 1. Advantageous developments of the invention are set forth in the subsidiary claims.

In the electric arc furnace according to the invention, the lift columns are provided on the side which is towards the furnace cover and on the side which is remote from the furnace cover, with respective pairs of spaced-apart tracks or raceways for the rollers of the roller guides and the track or raceway surfaces include an angle which is smaller than 180°, as viewed from the associated roller guides. In that way the lift columns can be arranged in side-by-side relationship with a very small spacing between them, because there is no need to provide space for the roller guides between the individual lift columns. Preferably, the lift columns are of a rectangular cross-section and are so arranged that the wide sides of adjacent lift columns are disposed in mutually opposing relationship with a small spacing from each other. The tracks or raceways for the rollers are then provided at the narrow sides of the rectangular cross-section.

By virtue of the small amount of area taken up by the lift columns including the roller guides, when considered in plan, it is possible to use a commercially available roller-type turntable as is employed for example in excavators and the like, so that there is no need to provide for a special production.

By virtue of its small spacing between the lift columns, the construction according to the invention is particularly suitable for an electric arc furnace in which, in accordance with the above-identified prior application, the electrode support arms are provided on their outside with a layer of copper or another material which is a good conductor, the layer forming the heavy-current conductor for the feed of current to the contact jaws which bear against the electrode. That arrangement makes it possible to achieve the desired small spacing between the individual support arms, without the outer electrode support arms requiring special projections at the locations for connection to the lift columns.

Figure 2:
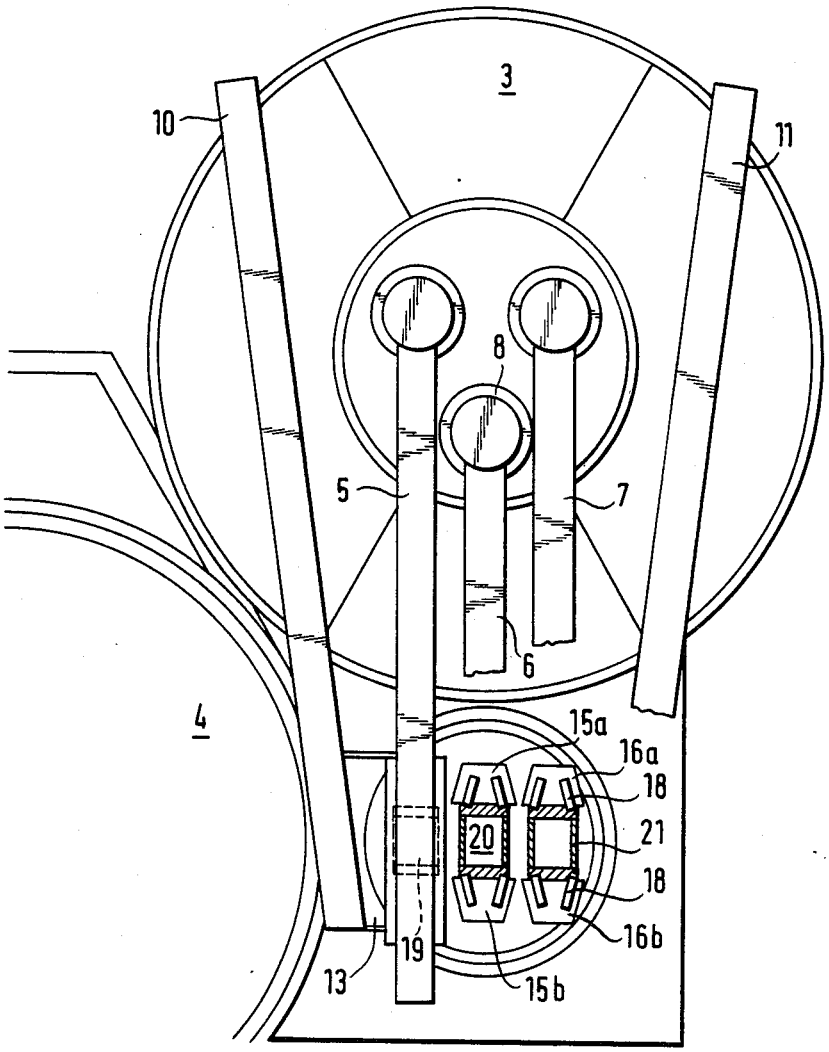
Figure 3:
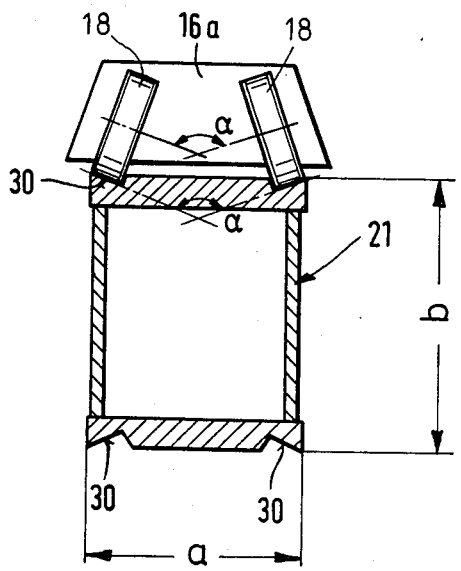

An embodiment of the invention is described in greater detail hereinafter by way of example with reference to the drawings in which:

FIG. 1 is a side view of a part of an electric arc furnace, with some parts partly broken away, FIG. 2 is a plan view of the electric arc furnace shown in FIG. 1, again with some parts being broken away, and FIG. 3 is a simplified view in horizontal section of a lift column with tracks or raceways.

Referring to FIG. 1, shown therein is an electric arc furnace 1 which rests on a furnace cradle 2 and which has a furnace roof or cover 3. In the condition shown in FIG. 1, the furnace cover 3 closes the electric arc furnace 1 while in the condition shown in FIG. 2, the cover 3 is pivoted to the side so that the interior 4 of the furnace 1 is open upwardly and the furnace can be charged.

The three-phase electric arc furnace has three substantially horizontally extending electrode support arms 5, 6 and 7 of which the electrode support arms 5 and 7 are disposed in a lower plane and the electrode support arm 6 is disposed in an upper plane. Secured to the respective ends thereof above the furnace 1 by means of respective holding devices 8 are electrodes 9 which project into the interior 4 of the furnace through associated electrode passages in the cover 3. The electrode support arms 5, 6 and 7 are provided at least on a part of the length thereof, at the outside thereof, with a layer (not shown) which is a good conductor of electricity and which in that region forms the heavy-current conductor for the supply of current to the contact jaw of the associated electrode.

Two substantially horizontally extending cover carrier arms 10 and 11 are components of a cover carrier mechanism which is not shown herein in all its details. The cover carrier arm 11 for example is connected to a gantry or portal structure 13 by means of a connecting portion 12. The portal structure 13 is a construction which is pivotable about a vertical axis A and which carries not only the cover carrier mechanism but also the entire electrode and electrode-holding assembly.

Fixedly disposed in the portal structure 13 are a plurality of roller guides, more specifically, in an upper plane, the roller guides 14*a*, 14*b*; 15*a*, 15*b* and 16*a*, 16*b*, with respective roller guides being associated therewith in a lower plane; FIG. 1 shows the lower roller guides 17*a* and 17*b* which are associated with the roller guides 14*a* and 14*b*.

As shown in FIG. 2, associated with each lift column in the upper roller guide plane are two pairs of rollers 14*a* and 14*b*, 15*a*, and 15*b* and 16*a* and 16*b* respectively, with the pairs being mounted in respective mounting blocks. The construction in the lower plane for the roller guides is the same.

The roller guides are provided for guiding lift columns 19, 20 and 21 which are arranged in a row, with the electrode support arms 5, 6 and 7 respectively being secured to the upper ends of the respective lift columns 19, 20 and 21. As can be seen from FIGS. 2 and 3, the lift columns 19, 20 and 21 are of a non-square, rectangular cross-section providing narrow sides a and wide sides b. The wide sides b of adjacent lift columns are disposed in opposite relationship to each other with a small spacing therebetween, so that the overall width of the arrangement is as small as possible. Two pairs of rollers are respectively associated with each lift column, disposed in two planes in each case, for example the roller guides 14*a* and 14*b* are associated with the lift column 19 in an upper plane and the roller guides 17*a* and 17*b* are associated with the lift column 19 in a lower plane, with each roller guide arrangement includes two rollers 18.

As can be seen from FIG. 2, the rollers 18, which are respectively associated with a lift column, of roller guide arangements in one plane, form an 'O' in plan view, that is to say, the axes of rotation of the rollers associated with a pair of rollers, for example the pair of the roller guide 15*a*, include an angle $\alpha$ which is less than 180° between them, as viewed from the side which is remote from the track or raceway surfaces. The angle $\alpha$ is preferably between 90° and 160°. By virtue of the inclined arrangement of the rollers, the roller bearings can carry moments about vertical axes. The 'O'-arrangement of the rollers advantageously increases the lever arm of the force couple of the rollers.

In order more clearly to show the structure, FIG. 3 is a simplified view in horizontal section of the lift column 21 with the pair of rollers of the roller guide 16*a*, which are mounted in a mounting block. The oppositely disposed pair of rollers is not shown in the drawing so that the configuration of the lift column can be more readily visible. Because, as stated, the axes of rotation of the two rollers of the roller guide 16*a* include an angle $\alpha$, the tracks or raceways 30 thereof, when the track or raceway surfaces are of a flat configuration, also include an angle $\alpha$ in the above-indicated range.

The portal structure 13 is connected by way of connecting members (not shown herein) to a horizontal carrier 22 beneath the furnace cradle 2 (see FIG. 1). Therefore any rotary movement of the portal structure 13 also involves a corresponding rotary movement of the carrier 22. The carrier 22 supports the individual lift columns 19, 20 and 21. Each lift column 19, 20 and 21 may be moved separately in an upward direction by way of lift cylinder units (not shown herein) so that the electrode support arm secured thereto is also moved upwardly and the associated electrode is raised.

The portal structure has a roller-type turntable 23 comprising a bottom turntable member 24 which is fitted in an opening 26 in the furnace cradle 2, and a top turntable member 25. Flanges 27 and 28 of the turntable members accommodate the rollers at their mutually facing sides. The top turntable member 25 can thus be pivoted with respect to the bottom stationary turntable member 24 about the vertical axis A which also corresponds to the longitudinal centre line of the lift column 20. The roller-type turntable 23 is a commercially available assembly as is used for example in excavators or similar machines.

In operation, the individual parts of the furnace occupy the position indicated in FIG. 1. For furnace charging purposes, the cover 3 is pivoted to the side so that the interior of the furnace is accessible. For that purpose, the individual lift columns 19, 20 and 21 are first moved upwardly, more specifically at least by such a distance that the lower ends (not shown in the drawings) of all electrodes lie at least above the upper edge of the furnace vessel and do not collide with the edge of the furnace when the pivotal movement is performed. The cover 3 is then lifted somewhat by means which are not shown herein. The cover 3 which is carried by the cover carrier mechanism 10 and 11 is then pivoted towards the side, together with the electrode support arms and the electrodes suspended thereon, until the interior of the furnace is free for charging purposes, so that the parts of the furnace occupy the position shown in FIG. 2. The pivotal movement is completed by rotating the top turntable member 25 by way of drive means (not shown herein).

The operation of closing the furnace is effected in a corresponding manner by carrying out the above-described steps in the reverse sequence.

I claim:

1. An electric arc furnace comprising a plurality of and in particular three electrode support arms, a plurality of and in particular three lift columns, each support arm being secured to a respective lift column, upper and lower roller guides comprising rollers for substantially vertically guiding a respective lift column, said lift columns being arranged in side-by-side relationship in a row and are provided, both on the side which is towards a cover of the furnace and on the side which is remote from the furnace cover, with respective pluralities of tracks for the rollers of the roller guides, a cover carrier mechanism, and a portal structure which is arranged beside the furnace and which is pivotable about a vertical axis, rollers for mounting said portal structure, said portal structure carrying the cover carrier mechanism and the roller guides for the lift columns, characterized in that two tracks are provided on each of said sides of each lift column, said tracks having surfaces including an angle ($\alpha$) which is smaller than 180° as viewed from the associated roller guides, and said portal structure being mounted on a roller-type turntable which surrounds the lift columns.

2. An electric arc furnace according to claim 1 characterised in that the two track surfaces of one side include an angle ($\alpha$) of 90° to 160°.

3. An electric arc furnace according to claim 1 characterised in that the lift columns are of a rectangular cross-section having narrow sides and wide sides and that the wide sides of adjacent lift columns are disposed in mutually opposing relationship with a small spacing therebetween.

4. An electric arc furnace according to claim 3 characterised in that the track surfaces are provided at the edges of the narrow sides.

5. An electric arc furnace according to any one of claims 1, 2, 3 or 4 characterised in that the roller-type turntable has a cylindrical top member and a cylindrical bottom member which is arranged non-rotatably on the furnace cradle.

6. An electric arc furnace according to claim 1 characterised in that the electrode support arms are provided at least on a part of the length thereof, at the outside thereof, with a layer of copper or the like which is a good electrical conductor and which is connected to a heavy-current supply means and to a contact jaw of an associated electrode.

* * * * *